US008485142B2

(12) United States Patent
Ozawa et al.

(10) Patent No.: US 8,485,142 B2
(45) Date of Patent: Jul. 16, 2013

(54) INTERNAL COMBUSTION ENGINE COOLING SYSTEM AND METHOD FOR DETERMINING FAILURE THEREIN

(75) Inventors: Yasuo Ozawa, Kariya (JP); Yoshikuni Ito, Nagoya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/508,884

(22) PCT Filed: Sep. 13, 2010

(86) PCT No.: PCT/JP2010/065737
§ 371 (c)(1),
(2), (4) Date: May 9, 2012

(87) PCT Pub. No.: WO2011/058815
PCT Pub. Date: May 19, 2011

(65) Prior Publication Data

US 2012/0227685 A1 Sep. 13, 2012

(30) Foreign Application Priority Data

Nov. 10, 2009 (JP) ..... 2009-256979

(51) Int. Cl.
*F01P 5/14* (2006.01)

(52) U.S. Cl.
USPC ..... 123/41.15; 123/198 D

(58) Field of Classification Search
USPC ..... 123/41.15, 198 D; 701/114; 73/116.02
See application file for complete search history.

(56) References Cited

U.S. PATENT DOCUMENTS

| | | | |
|---|---|---|---|
| 6,279,390 | B1 | 8/2001 | Oka et al. |
| 2004/0262411 | A1 | 12/2004 | Tsukamoto et al. |

FOREIGN PATENT DOCUMENTS

| | | | |
|---|---|---|---|
| DE | 36 33 411 | | 4/1988 |
| DE | 103 11 188 | | 9/2004 |
| EP | 2 487 346 | | 8/2012 |
| GB | 2 348 297 | | 9/2000 |
| JP | 55-130014 | U | 9/1980 |
| JP | 10-184433 | A | 7/1998 |
| JP | 2004-28062 | A | 1/2004 |
| JP | 2004-353592 | | 12/2004 |
| JP | 2005-188327 | A | 7/2005 |

(Continued)

OTHER PUBLICATIONS

Supplementary European Search Report issued by the European Patent Office on Nov. 16, 2012 in corresponding European Patent Application No. 10 82 9775.

(Continued)

*Primary Examiner* — Noah Kamen
(74) *Attorney, Agent, or Firm* — Buchanan Ingersoll & Rooney PC

(57) ABSTRACT

An internal combustion engine cooling system includes: an internal combustion engine; a water pump for circulating a fluid; a flow path for the fluid circulated at least between the internal combustion engine and the water pump; a first sensor disposed on the flow path through which the fluid flows from the internal combustion engine to the water pump; a first flow path provided with a fluid cooling means; a second flow path provided with a heat exchange means; a first valve provided on the flow path and configured to control inflow amounts of the fluid into the first flow path and the second flow path; a second valve provided on the second flow path and configured to control inflow of the fluid into the second flow path; and a controller for performing failure determination of the second valve based on a detection result of the first sensor.

9 Claims, 4 Drawing Sheets

FOREIGN PATENT DOCUMENTS

| | | | |
|---|---|---|---|
| JP | 2007-071145 | | 3/2007 |
| JP | 2008-111414 | A | 5/2008 |
| WO | WO 2011/042942 | | 4/2011 |

OTHER PUBLICATIONS

Office Action issued by the Japan Patent Office on Aug. 16, 2012 in corresponding Japanese Patent Application No. 2009-256979 and English translation thereof.

International Search Report (PCT/ISA/210) issued on Oct. 5, 2010, by the Japanese Patent Office as the International Searching Authority for International Application No. PCT/JP2010/065737.

Written Opinion (PCT/ISA/237) issued on Oct. 5, 2010, by the Japanese Patent Office as the International Searching Authority for International Application No. PCT/JP2010/065737.

International Preliminary Report on Patentability (PCT/IB/373) issued on May 15, 2012 in corresponding International Patent Application No. PCT/JP2010/065737, and English translation thereof.

INTERNAL COMBUSTION ENGINE COOLING SYSTEM AND METHOD FOR DETERMINING FAILURE THEREIN

TECHNICAL FIELD

The present invention relates to an internal combustion engine cooling system and a method for determining failure in the internal combustion engine cooling system.

BACKGROUND ART

An internal combustion engine mounted on a vehicle or the like is provided with cooling water in order to cool the internal combustion engine that generates heat. The cooling water is supplied to the internal combustion engine by a water pump and absorbs heat of the internal combustion engine. The cooling water which has absorbed the heat is supplied to a radiator and releases the heat of the cooling water by the radiator, and flows into the water pump again. In other words, the cooling water circulates between the internal combustion engine and the radiator by the water pump, and releases the heat of the internal combustion engine at the radiator.

In a cooling apparatus of the internal combustion engine described in Patent Document 1 (corresponding to the internal combustion engine cooling system in the present application), the cooling water discharged from a cooling water pump (corresponding to the water pump in the present application) is branched into two, with one being supplied to a cylinder block of the internal combustion engine, and the other being supplied to a cylinder head. Then, the cooling water flowed out from the cylinder block and the cylinder head merges after passing a thermostatic valve for the cylinder block and a thermostatic valve for the cylinder head, respectively.

CITATION LIST

Patent Literature

Patent Document 1: Japanese Unexamined Utility Model Application Publication No. 55-130014

SUMMARY OF INVENTION

Technical Problem

In the case of the configuration of Patent Document 1, when the thermostatic valve is out of order for some reason and becomes inoperative, the cooling water cannot be supplied to the cylinder block or the cylinder head. Therefore, the cooling of the internal combustion engine is not performed and the internal combustion engine is overheated, leading to inconveniences.

In view of the above, the present invention aims to provide an internal combustion engine cooling system for cooling the internal combustion engine by the cooling water, even when the valve constituting the cooling circuit of the internal combustion engine is out of order for some reason.

Solution to Problem

In order to solve the above-mentioned technical problem, a first feature of the internal combustion engine cooling system of the present invention lies in that it includes an internal combustion engine; a water pump for circulating a fluid; a flow path for the fluid circulated at least between the internal combustion engine and the water pump; a first sensor disposed on the flow path through which the fluid flows from the internal combustion engine to the water pump; a first flow path which constitutes the flow path and is provided with a fluid cooling means for cooling the fluid; a second flow path which constitutes the flow path and is provided with a heat exchange means for utilizing heat in the fluid; a first valve provided on the flow path and configured to control inflow amounts of the fluid into the first flow path and the second flow path; a second valve provided on the second flow path and configured to control inflow of the fluid into the second flow path; a controller for performing failure determination of the second valve based on a detection result of the first sensor, wherein the first valve is opened when the controller determines a failure of the second valve.

According to the present feature, even when the second valve is out of order for some reason, the first valve can be made open. Therefore, the flow path (first flow path) can be used that passes the water pump, the internal combustion engine and the fluid cooling means, and thus the internal combustion engine can be prevented from being overheated which would otherwise be caused by incapability to cool the internal combustion engine.

The second feature of the present invention lies in that the first valve is provided with a thermostat therein, and the controller opens the first valve by electrical heating.

According to the present feature, when a temperature of the cooling water passing through the first valve rises, or when the controller determines a failure of the second valve and the first valve is electrically heated, the first valve is opened. As a result, an amount of fluid flowing through the first flow path having the fluid cooling means increases, and the internal combustion engine can be prevented from being overheated.

The third feature of the present invention lies in that the flow path is provided with a second sensor, and the controller performs the failure determination of the second valve based on detection results of the first sensor and the second sensor.

When the second valve is out of order, there may be cases in which the fluid does not circulate and is stayed in the internal combustion engine. In this case, a fluid temperature of a fluid outflow portion increases relative to a water temperature of a fluid inflow portion of the internal combustion engine. According to the present feature, the failure determination of the second valve is performed with the use of two sensors (first sensor and second sensor), and therefore, even if the fluid cannot flow into the internal combustion engine temporarily, the first valve is opened to resume the flow of the fluid into the internal combustion engine.

The fourth feature of the present invention lies in that the controller performs the failure determination of the second valve based on a difference in the detection results between the first sensor and the second sensor.

According to the present feature, the failure determination of the second valve can be performed based on the difference in the detection results between the two sensors, and therefore, even if the fluid cannot flow into the internal combustion engine temporarily, the first valve is opened to resume the flow of the fluid into the internal combustion engine, by performing a simple failure determination.

The fifth feature of the present invention lies in that the controller performs the failure determination of the second valve by determining whether or not a difference in the detection results between the first sensor and the second sensor exceeds a predetermined value for a given period of time.

According to the present feature, even when the difference in the detection results between the two sensors exceeds the predetermined value, it is not determined that the second valve has a failure, unless the given period of time elapses. For example, even when the internal combustion engine rapidly produces heat due to sudden acceleration of the vehicle, if the second valve is properly operated, the fluid flowing through the flow path is circulated before the given period of time elapses, and the difference in the detection results of the two sensors becomes small. In this manner, by setting an interval of the given period of time, an erroneous determination that the second valve has a failure can be prevented.

The sixth feature of the present invention lies in that the controller is provided with an annunciation circuit for informing a user of a failure, when it is determined that the second valve has the failure.

According to the present feature, the user can be informed of the failure of the second valve, and thus the user can take measures in advance, such as stopping or repairing of the vehicle, before the internal combustion engine becomes out of order.

The seventh feature of the present invention lies in that each of the first sensor and the second sensor is a temperature sensor for measuring a temperature of the fluid.

According to the present feature, the temperature sensor is used, and no special detection means is required. Therefore, the present invention can be carried out at a low cost.

In order to solve the above-mentioned technical problem, a first method for determining failure in the internal combustion engine cooling system of the present invention is provided, the system including: an internal combustion engine; a water pump for circulating a fluid; a flow path for the fluid circulated at least between the internal combustion engine and the water pump; a temperature sensor disposed on the flow path through which the fluid flows; a first valve and a second valve provided on the flow path; and a controller for performing failure determination of the second valve based on a detection result of the temperature sensor and controlling an opening of the first valve, the method including: a step in which the controller determines whether or not an actuation of a heat exchange means disposed on the flow path is necessary; a step in which the controller opens the second valve; a step in which the controller performs the failure determination of the second valve by determining whether or not the detection result of the temperature sensor exceeds a predetermined value for a given period of time; and a step in which the controller sends an actuation signal to the first valve to open, when it is determined that the second valve has a failure.

According to the present feature, even when the second valve is out of order for some reason, the first valve can be made open. Therefore, a flow path (first flow path) can be used that passes the water pump, the internal combustion engine and the fluid cooling means, and thus the internal combustion engine can be prevented from being overheated which would otherwise be caused by incapability to cool the internal combustion engine.

A second method for determining failure in the internal combustion engine cooling system of the present invention is provided, the system including: an internal combustion engine; a water pump for circulating a fluid; a flow path for the fluid circulated at least between the internal combustion engine and the water pump; a first sensor and a second sensor disposed on the flow path through which the fluid flows; a first valve which has a heater and is provided on the flow path; a second valve provided on the flow path; and a controller for performing failure determination of the second valve based on detection results of the first sensor and the second sensor and controlling an opening of the first valve, the method including: a step in which the controller determines whether or not an actuation of a heat exchange means disposed on the flow path is necessary; a step in which the controller opens the first valve; a step in which the controller performs the failure determination of the second valve by determining whether or not a difference in the detection results between the first sensor and the second sensor exceeds a predetermined value for a given period of time; and a step in which the controller sends a signal to the heater to be actuated to open the first valve, when it is determined that the second valve has a failure.

According to the present feature, even when the second valve is out of order for some reason, the first valve can be made open. Therefore, the flow path (first flow path) can be used that passes the water pump, the internal combustion engine and the fluid cooling means, and thus the internal combustion engine can be prevented from being overheated which would otherwise be caused by incapability to cool the internal combustion engine. In addition, when the second valve is out of order, there may be cases in which the fluid does not circulate and is stayed in the internal combustion engine. In this case, the fluid temperature of the fluid outflow portion rises relative to the water temperature of the fluid inflow portion of the internal combustion engine. According to the present feature, the failure determination of the second valve is performed with the use of the two sensors (first sensor and second sensor), and therefore, even if the fluid cannot flow into the internal combustion engine temporarily, the first valve is opened to resume the flow of the fluid into the internal combustion engine.

DESCRIPTION OF EMBODIMENTS

Figure 1:
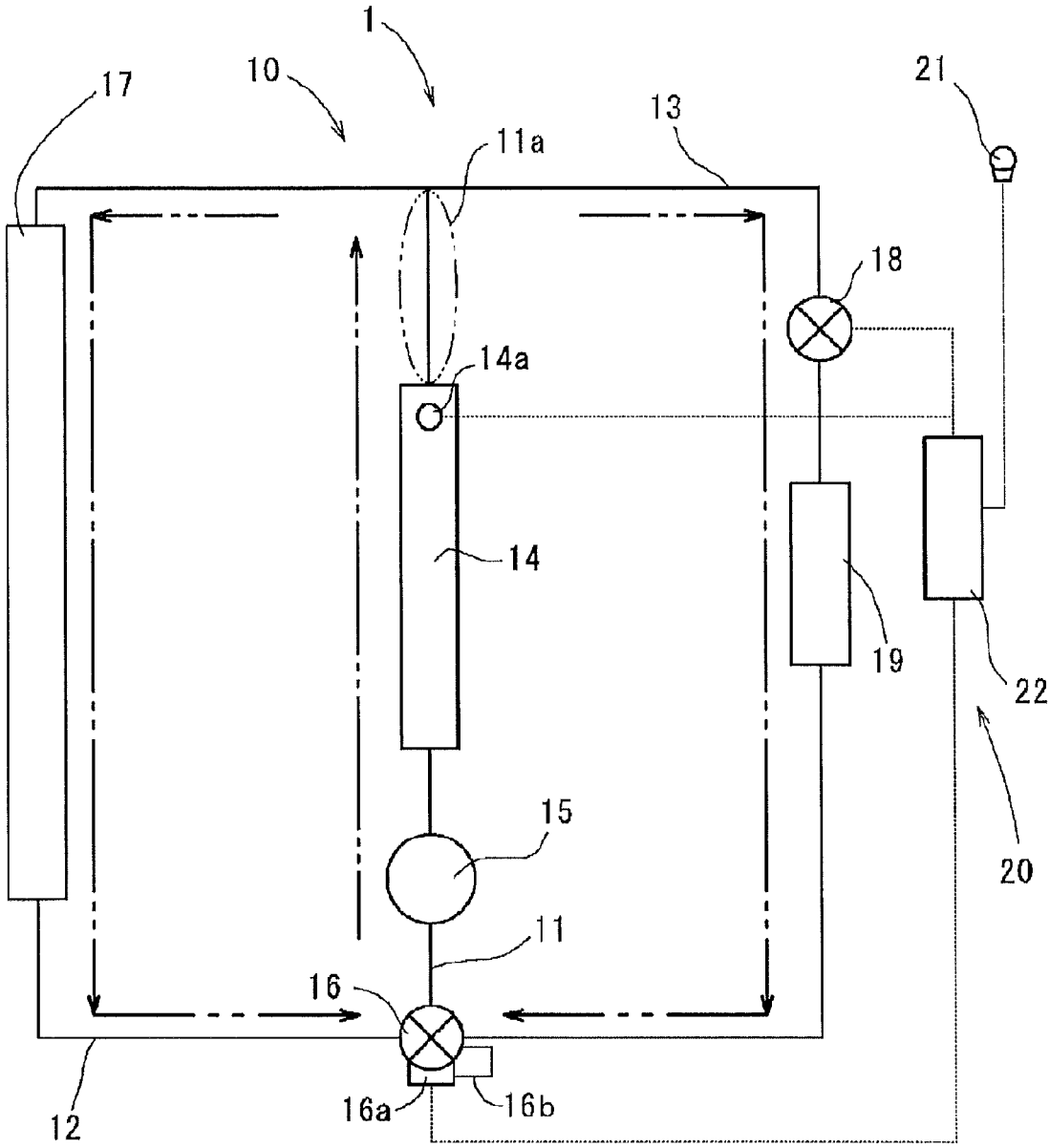
FIG. 1 is a diagram of an internal combustion engine cooling system in which an internal combustion engine is provided with a first sensor.
Figure 2:
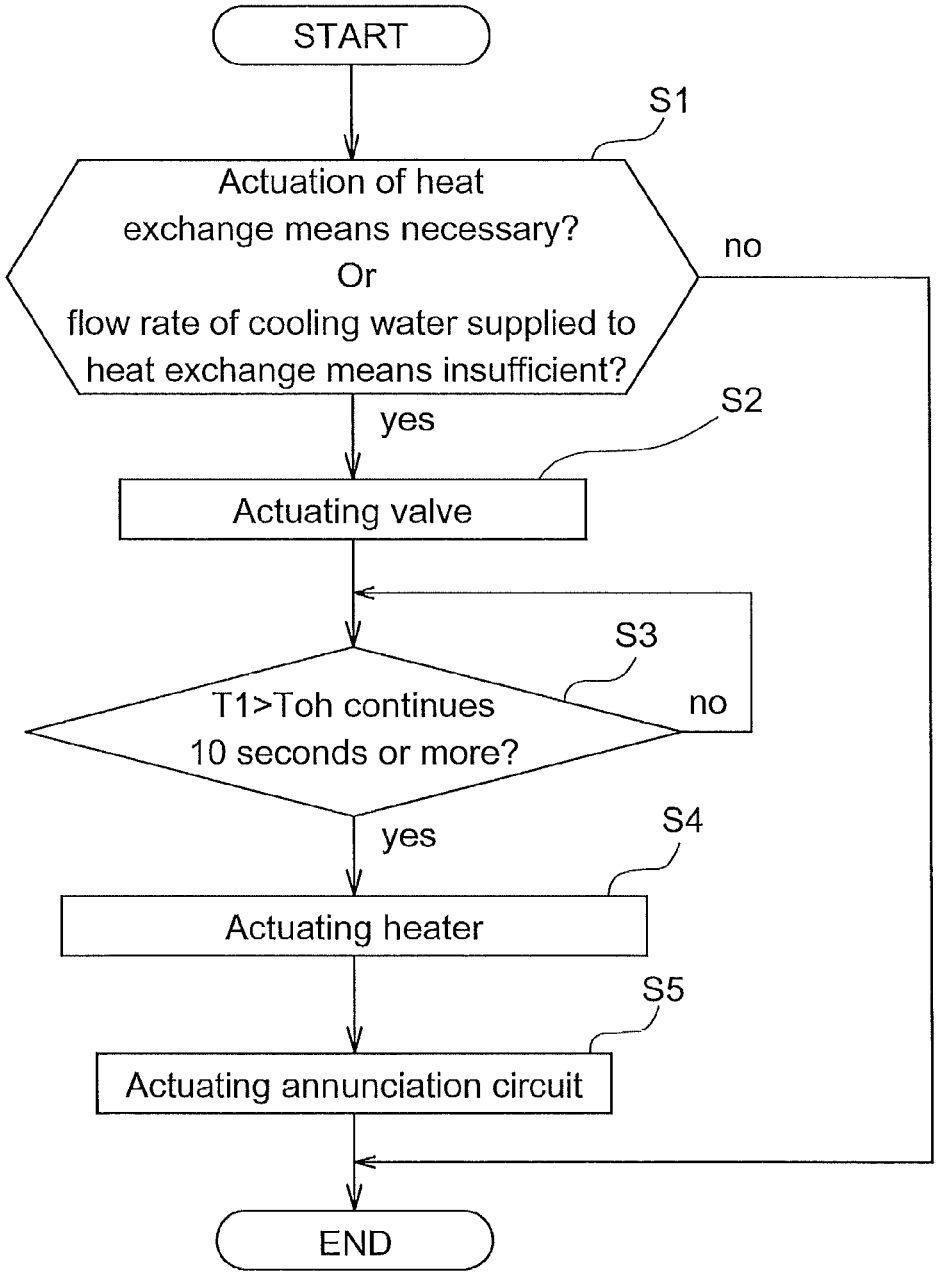
FIG. 2 is a flow chart showing a control processing in the internal combustion engine cooling system using the first sensor.

A first embodiment of the present invention will be described with reference to FIGS. 1 and 2.

First, an entire configuration will be described with reference to FIG. 1.

An internal combustion engine cooling system 1 includes: an internal combustion engine 14; a water pump 15 for circulating a fluid; a flow path 10 for the fluid (cooling water) circulated at least between the internal combustion engine 14 and the water pump 15; a first sensor 14*a* disposed on the flow path 10 through which the fluid flows from the internal combustion engine 14 to the water pump 15; a first flow path 12 which constitutes the flow path 10 and is provided with a fluid cooling means 17 for cooling the fluid; a second flow path 13 which constitutes the flow path 10 and is provided with a heat exchange means 19 for utilizing heat of the fluid; a first valve 16 provided on the flow path 10 and configured to control inflow amounts of the fluid into the first flow path 12 and the second flow path 13; a second valve 18 provided on the second flow path 13 and configured to control inflow of the fluid into the second flow path 13; and a control circuit 22 as controller for determining a failure of the second valve 18 based on a detection result of the first sensor 14*a*.

The flow path 10 is a cyclic path configured to supply the cooling water discharged from the water pump 15 to the internal combustion engine 14, supply the cooling water flowing out from the internal combustion engine 14 to at least one of the fluid cooling means 17 and the heat exchange means 19, and then allow the cooling water to flow into the water pump 15. The flow path 10 is formed of: the first flow path 12 passing through the water pump 15, the internal combustion engine 14 and the fluid cooling means 17; and the second flow path 13 passing through the water pump 15, the internal combustion engine 14 and the heat exchange means 19. It should be noted that, in the present embodiment, a portion shared by the first flow path 12 and the second flow path 13 is referred to as a common flow path 11.

The first sensor 14*a* is a water temperature sensor which is provided at a portion of the internal combustion engine 14 where the cooling water flows out and configured to detect a water temperature of the cooling water. The first sensor 14*a* is configured to transmit a detection result of the water temperature of the cooling water to the control circuit 22 which will be described later. It should be noted that, in the present embodiment, the first sensor 14*a* is provided at the cooling water outflow portion of the internal combustion engine 14, but it is not necessarily provided at the cooling water outflow portion of the internal combustion engine 14, as long as it is provided within a region 11*a* shown in FIG. 1 (i.e. a portion of the common flow path 11 between a cooling water outlet of the internal combustion engine 14 and a branch point to the first flow path 12 and the second flow path 13).

The fluid cooling means 17 is a radiator for cooling the cooling water that has absorbed heat of the internal combustion engine 14. By cooling the cooling water with the use of the fluid cooling means 17 (radiator), the cooling water can be circulated again to the internal combustion engine 14 so as to cool the internal combustion engine 14. In other words, by circulating the cooling water between the internal combustion engine 14 and the fluid cooling means 17 (radiator), the cooling water releases the heat of the internal combustion engine 14 at the fluid cooling means 17 (radiator).

The heat exchange means 19 is a device for transferring the heat of the cooling water which has been absorbed the heat of the internal combustion engine 14. The heat exchange means 19 is formed of, for example, an ATF (Automatic Transmission Fluid) warmer for heat exchange between an ATF and a cooling water used in automatic transmission of automobile, or a cabin heater for transmitting heat of the cooling water to an interior of the automobile to warm up the interior.

The first valve 16 is a flow rate control valve for adjusting the amount of the cooling water flowing through the first flow path 12 and the amount of the cooling water flowing through the second flow path 13. The first valve 16 is provided with a thermostat 16*b* therein, which adjusts flow rates of the first flow path 12 and the second flow path 13 in accordance with the heat of the cooling water passing through the first valve 16. The first valve 16 is configured, when the heat of the cooling water passing through the first valve 16 is increased, to limit the flow rate of the cooling water flowing through the second flow path 13 and to increase the flow rate of the cooling water flowing through the first flow path 12.

In addition, the first valve 16 is provided with a heater 16*a* for heating the thermostat 16*b*, which heater 16*a* is actuated based on a command from the control circuit 22 which will be described later. When the heater 16*a* is actuated, a similar effect is obtained to the effect in the case where the heat of the cooling water passing through the first valve 16 is increased: the flow rate of the cooling water flowing through the second flow path 13 is limited and the flow rate of the cooling water flowing through the first flow path 12 is increased.

The second valve 18 is a flow rate control valve disposed on a flow path of the second flow path 13 and configured to adjust a flow rate of the cooling water flowing through the heat exchange means 19. In the present embodiment, the second valve 18 is an electrically-driven valve actuated based on a command from the control circuit 22 which will be described later.

The control circuit 22 is a circuit which is electrically connected to the first sensor 14*a*, the heater 16*a* and the second valve 18, and configured to send commands to the heater 16*a* and the second valve 18 in accordance with the detection result of a cooling water temperature sent from the first sensor 14*a*. Specifically, the control circuit 22 controls the second valve 18 in such a manner that the amount of the cooling water passing through the second valve 18 is limited as the cooling water temperature detected by the first sensor 14*a* increases. In addition, to the control circuit 22, an annunciation circuit 21 is connected which is configured to inform the vehicle user of a failure of the second valve 18, when the control circuit 22 determines that the second valve 18 has the failure. The annunciation circuit 21 is configured to, for example, turn on an alarm lamp in a meter cluster frontward of a driver's seat to thereby inform the user of the failure. It should be noted that, in the present embodiment, the annunciation circuit 21 and the control circuit 22 are collectively referred to as a failure detection circuit 20.

Next, with reference to FIG. 2, determination of a failure of the second valve 18 by the failure detection circuit 20 will be described.

In a step S1, it is determined whether or not the heat exchange means 19 should be actuated. In this determination of the actuation, the amount of heat required by the heat exchange means 19 is determined, and at the same time, it is further determined whether or not the flow rate of the cooling water (amount of heat) supplied to the heat exchange means 19 is sufficient. When the control circuit 22 determines that the actuation of the heat exchange means 19 is necessary, or the flow rate of the cooling water (amount of heat) supplied to the heat exchange means 19 is insufficient (step S1: yes), the procedure advances to a step S2. When the control circuit 22 determines that the actuation of the heat exchange means 19 is unnecessary, or the flow rate of the cooling water (amount of heat) supplied to the heat exchange means 19 is sufficient (step S1: no), this failure determination is terminated.

In the step S2, the control circuit 22 sends a signal to the second valve 18 to open.

In a step S3, a water temperature T1 of the cooling water detected by the first sensor 14*a* is compared with a threshold Toh1 stored in the control circuit 22 in advance. Then, the control circuit 22 determines whether or not the relationship of T1>Toh1 is satisfied for a given period of time (for example, 10 seconds in the present embodiment). For example, when a load is placed on the internal combustion engine 14, e.g. when a vehicle is suddenly accelerated, T1 will be increased and exceed Toh1. In addition, when the flow rate of the fluid flowing through the common flow path 11 is insufficient, e.g. in a case where the second valve 18 is out of order in a closed state or in a half-opened state, the fluid is heated by the internal combustion engine 14, and the cooling water temperature inside the internal combustion engine 14 and at the first sensor 14*a* becomes higher than the cooling water temperature of other portions. When the second valve 18 is operated normally, even though T1 becomes larger than Toh1 (T1>Toh1) due to the sudden acceleration, the water temperature T1 is returned to or below Toh1 within a given period of time by the circulating cooling water, but when the second valve 18 is out of order, the temperature T1 detected by the first sensor 14*a* continues to increase. When the relationship of T1>Toh1 is satisfied for a given period of time (step S3: yes), the control processing advances to a step S4. When the relationship of T1>Toh1 is not satisfied for a given period of time (step S3: no), the control processing repeats the step S3 again.

In the step S4, the control circuit 22 sends a signal to the heater 16*a* of the first valve 16 to be actuated. By making the heater 16*a* produce heat, the first valve 16 limits the flow rate of the cooling water flowing through the second flow path 13 and increases the flow rate of the cooling water flowing through the first flow path 12.

In a step S5, the control circuit 22 sends an actuation signal to the annunciation circuit 21 to inform the user of the failure of the second valve 18, and this control processing is terminated.

According to the present embodiment, even when the second valve 18 is out of order for some reason, the first valve 16 can be made open based on the failure determination. Therefore, the first flow path 12 can be used that passes the water pump 15, the internal combustion engine 14 and the fluid cooling means 17, and thus the internal combustion engine 14 can be prevented from being overheated which would otherwise be caused by incapability to cool the internal combustion engine 14.

Figure 3:
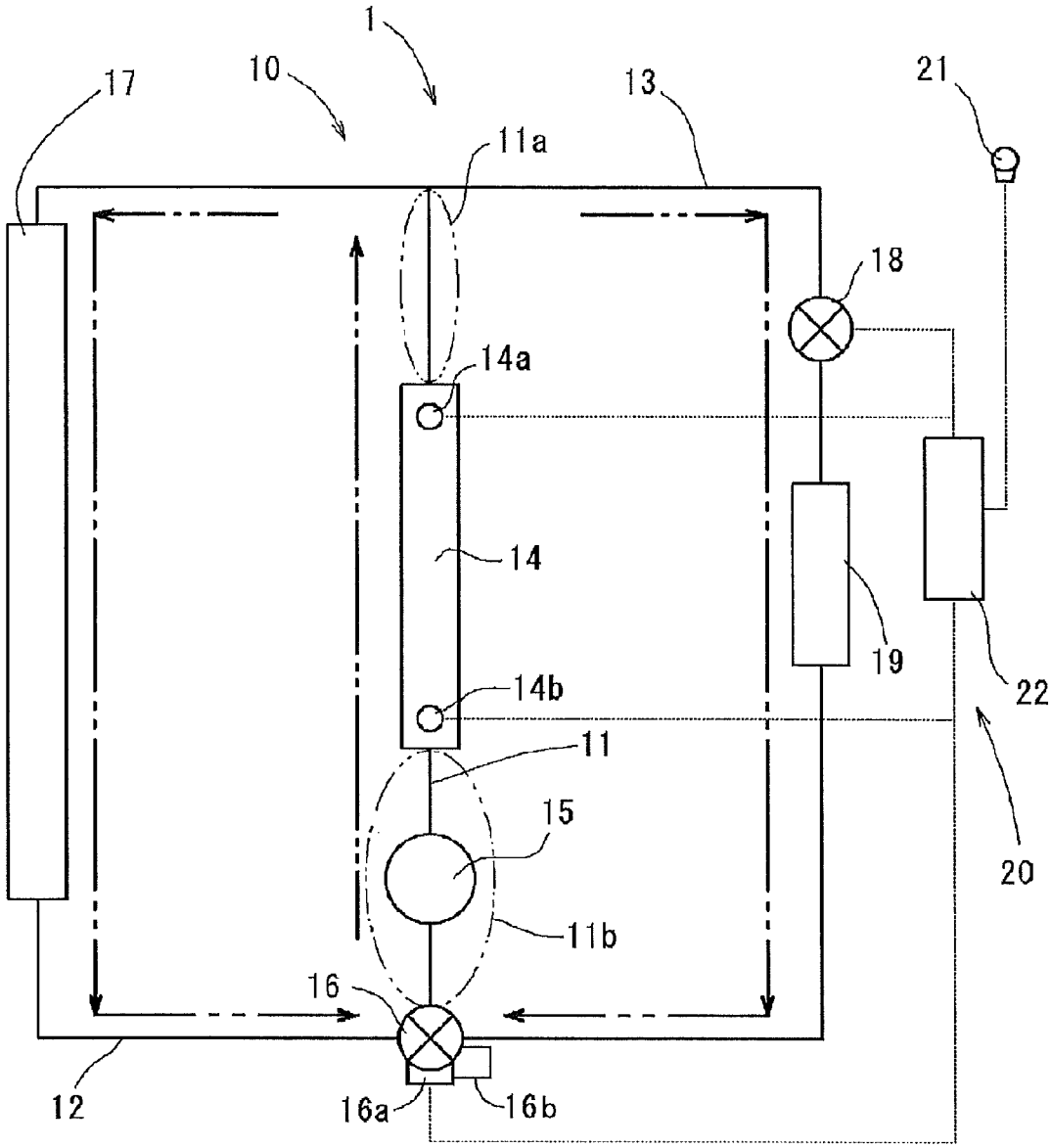
FIG. 3 is a diagram of an internal combustion engine cooling system in which the internal combustion engine is provided with the first sensor and a second sensor.
Figure 4:
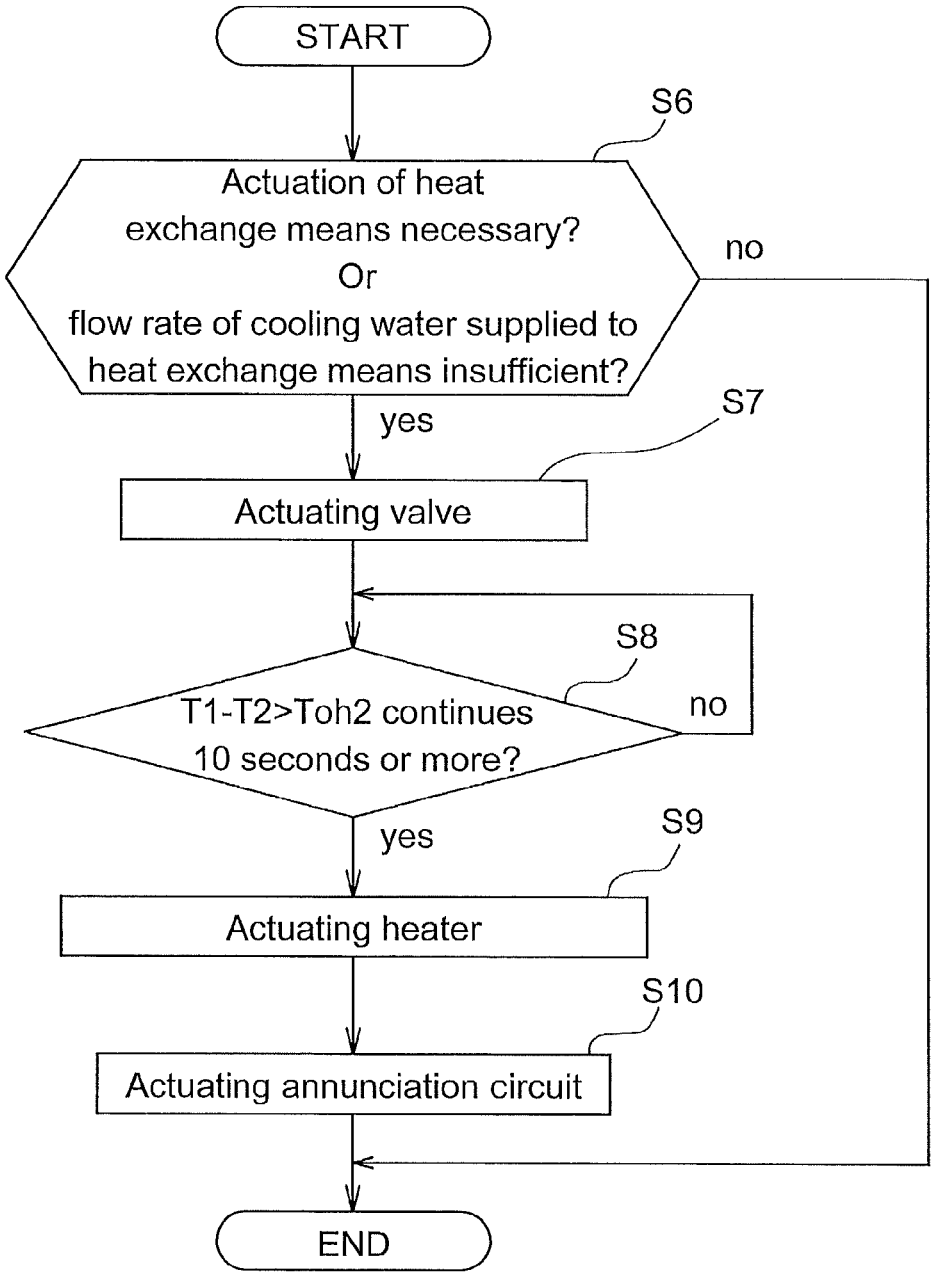
FIG. 4 is a flow chart showing a control processing in the internal combustion engine cooling system using the first sensor and the second sensor.

A second embodiment of the present invention will be described with reference to FIGS. 3 and 4. It should be noted that, in the present embodiment, a second sensor 14*b* is added to the cooling water inflow portion of the internal combustion engine 14, as compared with the first embodiment. Therefore, for the same component, the same reference character is used.

The second sensor 14*b* is a water temperature sensor which is provided at a portion of the internal combustion engine 14 where the cooling water flows in and configured to detect the water temperature of the cooling water. The second sensor 14*b* is configured to transmit a detection result of the water temperature of the cooling water to the control circuit 22. It should be noted that, in the present embodiment, the second sensor 14*b* is provided at the cooling water inflow portion of the internal combustion engine 14, but it is not necessarily provided at the cooling water inflow portion of the internal combustion engine 14, as long as it is provided within a region 11*b* shown in FIG. 3.

The second sensor 14*b* is a water temperature sensor which is provided at a portion of the internal combustion engine 14 where the cooling water flows in and configured to detect the water temperature of the cooling water. The second sensor 14*b* is configured to transmit a detection result of the water temperature of the cooling water to the control circuit 22 described above. It should be noted that, in the present embodiment, the second sensor 14*b* is provided at the cooling water inflow portion of the internal combustion engine 14, but it is not necessarily provided at the cooling water inflow portion of the internal combustion engine 14, as long as it is provided within the region 11*b* shown in FIG. 3 (i.e. a portion of the common flow path 11 between the first valve 16 and the cooling water inlet of the internal combustion engine 14).

Next, with reference to FIG. 4, determination of a failure of the second valve 18 by the failure detection circuit 20 will be described.

In a step S6, it is determined whether or not the heat exchange means 19 should be actuated. In this determination of the actuation, the amount the heat required by the heat exchange means 19 is determined, and at the same time, it is further determined whether or not the flow rate of the cooling water (amount of heat) supplied to the heat exchange means 19 is sufficient. When the control circuit 22 determines that the actuation of the heat exchange means 19 is necessary, or the flow rate of the cooling water (amount of heat) supplied to the heat exchange means 19 is insufficient (step S6: yes), the procedure advances to a step S7. When the control circuit 22 determines that the actuation of the heat exchange means 19 is unnecessary, or the flow rate of the cooling water (amount of heat) supplied to the heat exchange means 19 is sufficient (step S6: no), this failure determination is terminated.

In the step S7, the control circuit 22 sends a signal to the second valve 18 to open.

In a step S8, a difference between the water temperature T1 of the cooling water detected by the first sensor 14*a* and a water temperature T2 of the cooling water detected by the second sensor 14*b*, is compared with a threshold Toh2 stored in the control circuit 22 in advance. Then, the control circuit 22 determines whether or not the relationship of T1−T2>Toh2 is satisfied for a given period of time (for example, 10 seconds in the present embodiment). For example, when a load is placed on the internal combustion engine 14, e.g. when a vehicle is suddenly accelerated, T1−T2 will be increased and exceed Toh2. In addition, when the flow rate of fluid flowing through the common flow path 11 is insufficient, e.g. in a case where the second valve 18 is out of order in a closed state or in a half-opened state, the fluid is heated by the internal combustion engine 14 and the cooling water temperature inside the internal combustion engine 14 and at the first sensor 14*a* and the second sensor 14*b* becomes higher than the cooling water temperature of other portions. When the second valve 18 is operated normally, even though T1−T2 becomes larger than Toh2 (T1−T2>Toh2) due to the sudden acceleration, T1−T2 is returned to or below Toh2 within a given period of time by the circulating cooling water, but when the second valve 18 is out of order, the temperature T1 detected by the first sensor 14*a* continues to increase. When the relationship of T1−T2>Toh2 is satisfied for a given period of time (step S8: yes), the control processing advances to a step S9. When the relationship of T1−T2>Toh2 is not satisfied for a given period of time (step S8: no), the control processing repeats the step S8 again.

In the step S9, the control circuit 22 sends a signal to the heater 16*a* of the first valve 16 to be actuated. By making the heater 16*a* produce heat, the first valve 16 limits the flow rate of the cooling water flowing through the second flow path 13 and increases the flow rate of the cooling water flowing through the first flow path 12.

In a step S10, the control circuit 22 sends an actuation signal to the annunciation circuit 21 to inform the user of the failure of the second valve 18, and this control processing is terminated.

According to the resent embodiment, even when the second valve 18 is out of order for some reason, the first valve 16 can be made open based on the failure determination. Therefore, the first flow path 12 can be used that passes the water pump 15, the internal combustion engine 14 and the fluid cooling means 17, and thus the internal combustion engine 14 can be prevented from being overheated which would otherwise be caused by incapability to cool the internal combustion engine 14.

Further, according to the present embodiment, when the second valve 18 is out of order, there may be cases in which the fluid does not circulate and is stayed in the internal combustion engine 14. In this case, the fluid temperature (T1) of the fluid outflow portion of the internal combustion engine 14 increases relative to the water temperature (T2) of the fluid inflow portion. However, the failure determination of the second valve 18 is performed with the use of two sensors (the first sensor 14*a* and the second sensor 14*b*), and therefore, even if the fluid cannot flow into the internal combustion engine 14 temporarily, the first valve 16 is opened to resume the flow of the fluid into the internal combustion engine 14.

It should be noted that, in the first and second embodiments, the descriptions are made while referring the first valve 16 as being in the opened state or in the closed state. Herein, the opened state of the first valve 16 means a state in which the cooling water can circulate through the first flow path 12 and the closed state of the first valve 16 means a state in which the cooling water can circulate through the second flow path 13.

Reference Signs List

1 Internal combustion engine cooling system
10 Flow path
11 Common flow path (flow path)
12 First flow path (flow path)
13 Second flow path (flow path)
14 Internal combustion engine
14*a* First sensor
14*b* Second sensor
15 Water pump
16 First valve
16*a* Heater
16*b* Thermostat
17 Fluid cooling means
18 Second valve
19 Heat exchange means
20 Failure detection circuit
21 Annunciation circuit
22 Control circuit (controller)

The invention claimed is:

1. An internal combustion engine cooling system comprising:
an internal combustion engine;
a water pump for circulating a fluid;
a flow path for the fluid circulated at least between the internal combustion engine and the water pump;
a first sensor disposed on the flow path through which the fluid flows from the internal combustion engine to the water pump;
a first flow path which constitutes the flow path and is provided with a fluid cooling means for cooling the fluid;
a second flow path which constitutes the flow path and is provided with a heat exchange means for utilizing heat in the fluid;
a first valve provided on the flow path and configured to control inflow amounts of the fluid into the first flow path and the second flow path;
a second valve provided on the second flow path and configured to control inflow of the fluid into the second flow path; and
a controller for performing failure determination of the second valve based on a detection result of the first sensor,
wherein the first valve is opened when the controller determines a failure of the second valve.

2. The internal combustion engine cooling system according to claim 1, wherein the first valve is provided with a thermostat therein, and the controller opens the first valve by electrical heating.

3. The internal combustion engine cooling system according to claim 1, wherein
the flow path is provided with a second sensor, and
the controller performs the failure determination of the second valve based on detection results of the first sensor and the second sensor.

4. The internal combustion engine cooling system according to claim 3, wherein the controller performs the failure determination of the second valve based on a difference in the detection results between the first sensor and the second sensor.

5. The internal combustion engine cooling system according to claim 3, wherein the controller performs the failure determination of the second valve by determining whether or not a difference in the detection results between the first sensor and the second sensor exceeds a predetermined value for a given period of time.

6. The internal combustion engine cooling system according to claim 3, wherein each of the first sensor and the second sensor is a temperature sensor for measuring a temperature of the fluid.

7. The internal combustion engine cooling system according to claim 1, wherein the controller is provided with an annunciation circuit for informing a user of a failure, when it is determined that the second valve has the failure.

8. A method for determining failure in an internal combustion engine cooling system, the system comprising:
an internal combustion engine;
a water pump for circulating a fluid;
a flow path for the fluid circulated at least between the internal combustion engine and the water pump;
a temperature sensor disposed on the flow path through which the fluid flows;
a first valve and a second valve provided on the flow path; and
a controller for performing failure determination of the second valve based on a detection result of the temperature sensor and controlling an opening of the first valve,
the method comprising:
a step in which the controller determines whether or not an actuation of a heat exchange means disposed on the flow path is necessary;
a step in which the controller opens the second valve;
a step in which the controller performs the failure determination of the second valve by determining whether or not the detection result of the temperature sensor exceeds a predetermined value for a given period of time; and
a step in which the controller sends an actuation signal to the first valve to open, when it is determined that the second valve has a failure.

9. A method for determining failure in an internal combustion engine cooling system, the system comprising:
an internal combustion engine;
a water pump for circulating a fluid;
a flow path for the fluid circulated at least between the internal combustion engine and the water pump;
a first sensor and a second sensor disposed on the flow path through which the fluid flows;
a first valve which has a heater and is provided on the flow path;
a second valve provided on the flow path; and
a controller for performing failure determination of the second valve based on detection results of the first sensor and the second sensor and controlling an opening of the first valve,
the method comprising:
a step in which the controller determines whether or not an actuation of a heat exchange means disposed on the flow path is necessary;
a step in which the controller opens the first valve;

a step in which the controller performs the failure determination of the second valve by determining whether or not a difference in the detection results between the first sensor and the second sensor exceeds a predetermined value for a given period of time; and a step in which the controller sends a signal to the heater to be actuated to open the first valve, when it is determined that the second valve has a failure.

* * * * *